US006119610A

United States Patent [19]

Nishizawa

[11] Patent Number: 6,119,610

[45] Date of Patent: Sep. 19, 2000

[54] SEWING MACHINE CONTROLLER

[75] Inventor: Yoshifumi Nishizawa, Tokyo, Japan

[73] Assignee: Mitsubishi Denki Kabushiki Kaisha, Tokyo, Japan

[21] Appl. No.: 09/381,227

[22] PCT Filed: Feb. 27, 1998

[86] PCT No.: PCT/JP98/00808

§ 371 Date: Sep. 17, 1999

§ 102(e) Date: Sep. 17, 1999

[87] PCT Pub. No.: WO99/43882

PCT Pub. Date: Sep. 2, 1999

[51] Int. Cl.[7] ..... D05B 19/12

[52] U.S. Cl. ..... 112/470.04; 112/220; 112/275

[58] Field of Search ..... 112/470.01, 275, 112/277, 470.04, 220; 318/466

[56] References Cited

U.S. PATENT DOCUMENTS

| | | | |
|---|---|---|---|
| 4,602,577 | 7/1986 | Kothe et al. | 112/275 X |
| 5,050,513 | 9/1991 | Frankel | 112/275 X |
| 5,778,810 | 7/1998 | Akahane et al. | 112/470.01 |

FOREIGN PATENT DOCUMENTS 5-115653 5/1993 Japan .

OTHER PUBLICATIONS

Foreign Language International Search Report, May 19, 1998.

*Primary Examiner*—Peter Nerbun

*Attorney, Agent, or Firm*—Sughrue, Mion, Zinn, Macpeak & Seas, PLLC

[57] ABSTRACT

A controller for a sewing machine includes a driving motor 7 for driving a main shaft of a sewing machine head; a detecting unit 9 having a rotation-angle detecting means for detecting a rotational angle of the motor 7; a control section 40 for controlling the motor 7 and receiving a detection signal of the detecting unit 9; an operating section 30 for instructing the operation of the sewing machine; a designating means 34 provided in the control section 40 or the operating section 30 for designating a predetermined position in a vertically moving process of a needle 5 of the sewing machine; and a first memory portion 55 and a second memory portion 131 capable of storing and reading a value designated by the designating means, wherein the first memory portion 55 is provided in the control section 40, and the second memory portion 131 is provided in the detecting unit 9 or the operating section 30.

5 Claims, 7 Drawing Sheets

SEWING MACHINE CONTROLLER

TECHNICAL FIELD

The present invention relates to a controller for a sewing machine using an encoder for detecting the angle of rotation of a motor for driving a needle, so as to overcome drawbacks which occur at the time of replacement of the motor.

BACKGROUND ART

Referring to FIGS. 5 to 7, a description will be given of a conventional sewing machine. In FIGS. 5 and 6, a sewing machine is comprised of a driving section 1 having a motor 7 for effecting such as the vertical movement of a needle 5, an operating section 30 for imparting a control command to the driving section 1, and a control section 40 for driving and controlling the driving section 1 on the basis of the command from the operating section 30.

The driving section 1 is connected to a solenoid 3 for driving a sewing machine head, through a motor-side pulley 19 connected to a shaft of a motor 7 meshing with a timing belt 17, and through a sewing-machine-side pulley 15 connected to a shaft 11 of the sewing machine meshing with the timing belt 17. It should be noted that an encoder 9 serving as a rotational-angle detecting means for detecting the rotational angle of the motor 7 is connected to the shaft of the motor 7, and a needle position detector 13 for detecting an upper position, shown in FIG. 7, of the needle 5 is connected to an end of the shaft 11 of the sewing machine.

The operating section 30 has a plurality of switches 32 for imparting commands to the driving section 1, the solenoid 3, the encoder 9, and the like, as well as a display unit 36 constituted by a liquid-crystal display for displaying the contents of operation of the switches 32.

The control section 40 has a control-command generating unit 50 for generating commands for controlling the motor 7, the encoder 9, and the like, as well as a driving unit 60 for obtaining a signal for driving the encoder 7 on the basis of a signal from the control-command generating unit 50.

The control-command generating unit 50 has an interface portion (hereafter referred to as the I/O) serving as a connecting portion for transmitting and receiving electrical signals with respect to the operating section 30; an I/O 52 serving as a connecting portion for transmitting and receiving electrical signals to and from the encoder 9; a CPU 53 for supervising and controlling; a nonvolatile memory portion (hereafter referred to as the control memory) 55 for storing various data and capable of electrically writing and erasing the data; and an I/O 57 serving as a connecting portion for transmitting an electrical signal to the driving section 60.

The driving unit 60 has an I/O 62 for receiving an electrical signal from the I/O 57 of the control-command generating unit 50, as well as an I/O 64 for transmitting an electrical signal to the motor 7. Connectors 70 and 72 are provided for detachably connecting output lines of the control section to a lead wire of the motor 7 and a lead wire of the encoder 9.

Since the conventional sewing machine is configured as described above, there have been drawbacks in that since an unillustrated upper-position detecting disk inside the needle position detector 13 is attached to the shaft 11 of the sewing machine and rotates at high speed, the upper-position detecting disk is liable to break down, and since the sewing machine must be driven after positioning the disk, the operation is intricate.

To overcome such drawbacks, it is conceivable to provide an arrangement in which, as shown in FIG. 6, an angle setting switch 34 is added for setting the angle of the motor 7 corresponding to the upper position of the needle 5 (this angle will be hereafter referred to as the upper-position angle), and to effect the operation as will be described below.

First, after the power supply of the control section 40 is turned on, the operator moves the needle 5 to the point of upper position thereof, i.e., to the value A (a motor rotation angle Ua) of a sawtooth output waveform of the encoder 9, as shown in FIG. 7. If the operator then turns on the angle setting switch 34, the display unit displays "UPSET," and the state is set in the set standby state. If the operator turns on the angle setting switch 34 again, the control CPU 53 stores the value Ua of the upper-position angle (the output waveform value A of the encoder 9) in the control memory 55. At this upper-position angle, the sewing machine is readily operable.

However, if the motor 7 breaks down due to some cause or other and is replaced with another motor 7, since a reference point of the rotating position is provided on the sewing machine-side pulley 19 to simplify the adjustment, and the sewing machine-side pulley 19 is connected to the motor shaft 11 through the timing belt 17, the reference point for the motor-side pulley 15 deviates, and the sawtooth output waveform of the encoder 7 becomes those shown at the solid lines and the chain lines as shown in FIG. 7, so that the upper-position angle changes from Ua to Ui, thereby producing a large error in the detection of the upper position of the needle 5. Accordingly, there has been a problem in that if the sewing machine is driven on the basis of this error, the sewn object is conceivably difficult to remove from the needle 5.

In addition, there has been another problem in that in a case where the control section 40 has broken down, if the control section is replaced, since only the control section 40 stores the upper-position angle of the needle 5, the upper-position angle must be set again, which is troublesome.

DISCLOSURE OF THE INVENTION

The present invention is provided to overcome the above-described problems, and the object thereof is to provide a simple controller for a sewing machine in which drawbacks are difficult to occur even if the control section or the motor is replaced.

To attain this object, according to a first aspect of the present invention, a controller for a sewing machine comprises: a driving motor for driving a main shaft of a sewing machine head; a detecting unit having a rotation-angle detecting means for detecting a rotational angle of the motor; a control unit for controlling the motor and receiving a detection signal of the detecting unit; an operating section for instructing the operation of the sewing machine; a designating means provided in the control section or the operating section for designating a predetermined position in a vertically moving process of a needle of the sewing machine; and a first memory portion and a second memory portion capable of storing and reading a value designated by the designating means, wherein the first memory portion is provided in the control section, and the second memory portion is provided in the detecting unit or the operating section.

According to a second aspect of the present invention, a controller for a sewing machine comprises: a driving motor for driving a main shaft of a sewing machine head; a motor-replacement detecting means for detecting that the motor has been replaced with another motor; and a starting prohibiting means for prohibiting the starting of the motor if the replacement is detected by the motor-replacement detecting means.

According to a third aspect of the present invention, a controller for a sewing machine comprises: a driving motor for driving a main shaft of a sewing machine head; a motor-replacement detecting means for detecting that the motor has been replaced with another motor; and a designating means for designating a predetermined position of the needle if the replacement is detected by the motor-replacement detecting means.

According to a fourth aspect of the present invention, a controller for a sewing machine is characterized in that the motor-replacement detecting means comprises: a value designating means for designating an identification value of the motor; an identification-value storing means for storing the identification value designated by the value designating means; and a determining means for determining whether or not the identification value of the motor and the identification value of another motor agree with each other.

According to a fifth aspect of the present invention, a controller for a sewing machine is characterized in that the motor-replacement detecting means comprises: a voltage detecting unit for effecting the detection by the attenuation of a voltage value of the detecting unit, an assumption being made on the basis of the attenuation of the voltage value of the voltage detecting unit that the motor has been replaced.

BEST MODE FOR CARRYING OUT THE INVENTION

Next, a description will be given hereafter of the embodiments of the present invention.

First Embodiment

Figure 1:
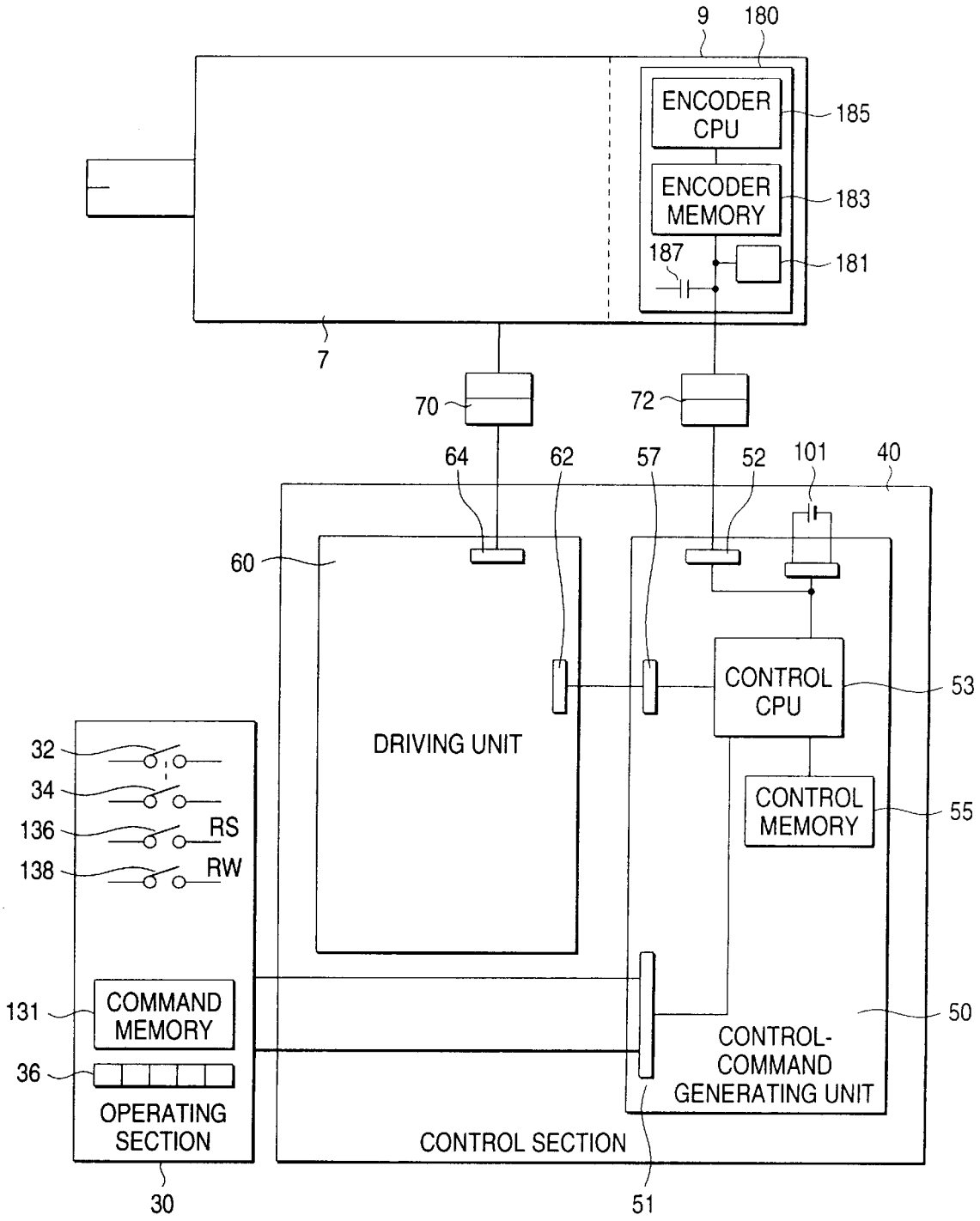
FIG. 1 is a block diagram illustrating an overall controller for a sewing machine in accordance with an embodiment of the present invention.

Referring to FIG. 1, a description will be given of an embodiment of the present invention. FIG. 1 is a block diagram illustrating an overall controller for a sewing machine. In the drawing, the same reference numerals as those of the conventional controller indicate identical or corresponding portions, and a description thereof will be omitted.

The controller for a sewing machine comprises an operating section 30, a control section 40, and an encoder controlling section 180. The operating section 30 has a command memory 131 constituted by a nonvolatile storage device capable of electrically reading and writing, a read switch 136, and a write switch 138.

The control section 40 has a battery 101 for backup, and the encoder controlling section 180 has a voltage detecting unit 181 for detecting whether or not a supply voltage has been supplied from the control section 40, an encoder memory 183 constituted by a nonvolatile storage device capable of electrically reading and writing, an encoder CPU 185 for controlling the encoder 9, and a capacitor 187 for attenuating the value of a supply voltage at the encoder controlling unit 180 by a predetermined time constant.

Figure 2:
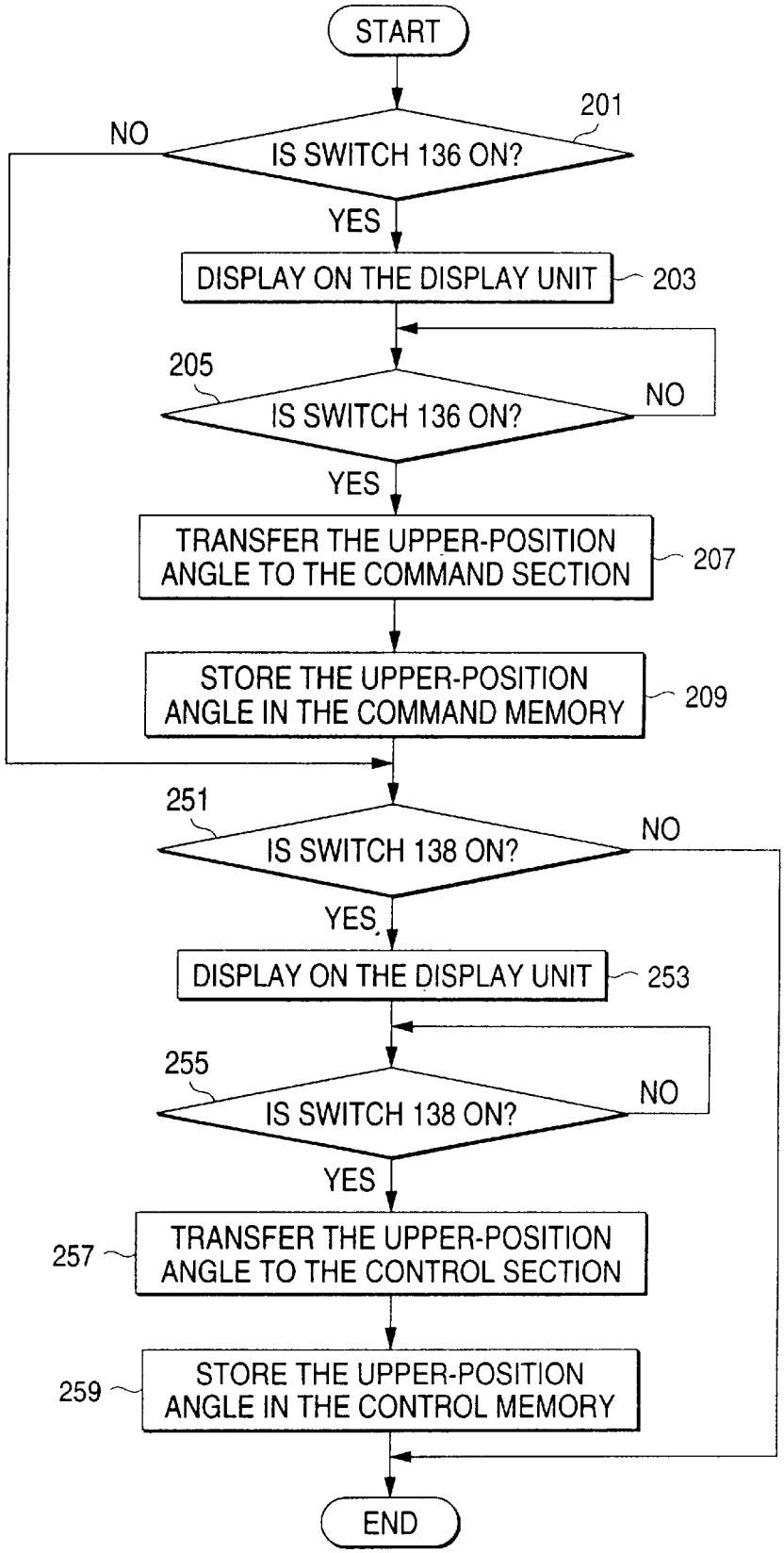
FIG. 2 is a flowchart illustrating the operation of the controller for a sewing machine shown in FIG. 1.

Referring to FIGS. 1 and 2, a description will be given of the controller for a sewing machine which is configured as described above. The read switch 136 of the operating section 30 is turned on from an off state (Step 201), whereupon a display unit 36 displays "UPSRE" (Step 203), and a control CPU 53 prompts the transfer of the upper-position angle of the sewing machine stored in a control memory 55 from the control section 40 to the operating section 30. Here, if the read switch 136 is turned on (Step 205), the control CPU 53 reads the upper-position angle of a needle 5 from the control memory 55, transfers the upper-position angle to the operating section 30 through an I/O 51 (Step 207), and stores the upper-position angle in the command memory 131 (Step 209).

Here, if the control section 40 is replaced with another control section 40 due to some cause or other, since the upper-position angle is not stored in the control memory 55, the upper-position angle is stored in the control memory 55, as will be described below.

First, if the write switch 138 of the operating section 30 is turned on (Step 251), the display unit 36 displays "UPSWR," thereby displaying a state in which the upper-position angle of the needle 5 stored in the command memory 131 can be transferred to the control memory 55 (Step 253). Here, if the write switch 138 is turned on (Step 255), the control CPU 53 reads the upper-position angle of the needle 5 from the command memory 131, transfers the upper-position angle to the control section 40 through the I/O 51 (Step 257), and stores the upper-position angle in the control memory 55 (Step 259).

It should be noted that although, in the above-described embodiment, the upper-position angle of the needle 5 is stored in the command memory 131, and the data in the command memory 131 is stored in the control memory 55, the upper-position angle may be stored in the encoder memory 183 and the data in the encoder memory 183 may be stored in the control memory 55.

Second Embodiment

Figure 3:
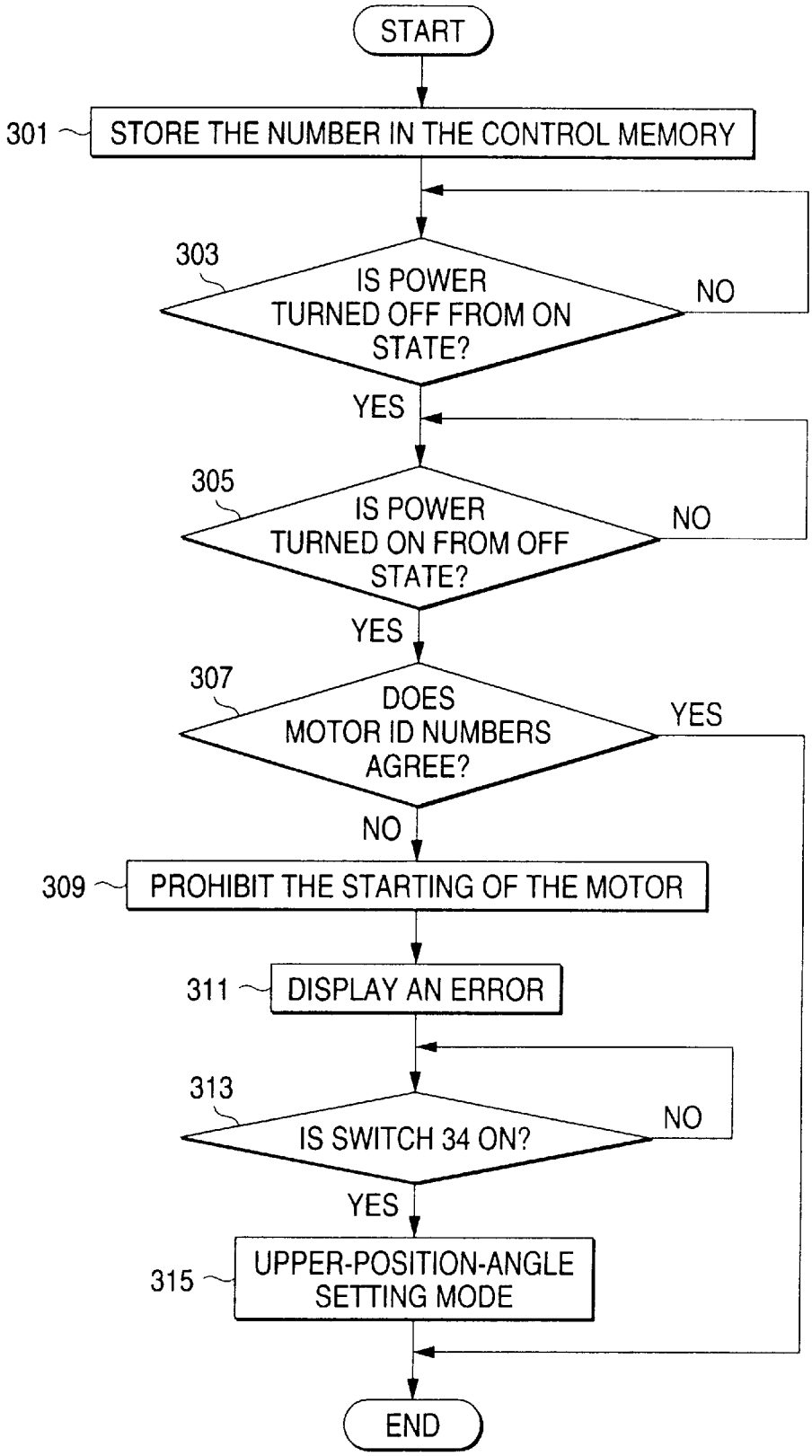
FIG. 3 is a flowchart illustrating other operation of the controller for a sewing machine shown in FIG. 1.

Referring to FIG. 3, a description will be given of another embodiment of the present invention. In this embodiment, the replacement of the motor is detected by the attenuation of a voltage value of the power supply of the control section 40, and, for example, a predetermined angle is set for the needle 5. At the time of shipment, for instance, an identification number of a motor 7 is inputted to an unillustrated input device, and the identification number of the motor 7 is written in the encoder memory 183 of the motor 7 through this identification number.

The CPU 53 of the control section reads the identification number from the encoder memory 183 as the power supply is turned on from the off state, transfers this number to the control section 40, and stores it in the control memory 55 (Step 301).

Next, a determination is made whether the power supply of the control section 40 can be turned off from an on state due to the failure of the motor 7 attributable to some cause or other (Step 303). If the power supply can be turned off from the on state, the motor 7 (including the encoder 9) is replaced, and a determination is made as to whether or not the power supply can be turned on from the off state (Step 305). If the power supply can be turned on from the off state, the control CPU 53 reads from the control memory 55 a first identification number of the motor at the time when the power supply was turned off on the occasion before the last, and the control CPU 53 reads a second identification number from the encoder memory 183 and compares the first and second identification numbers (Step 307). If they agree with each other, this processing ends.

Figure 7:
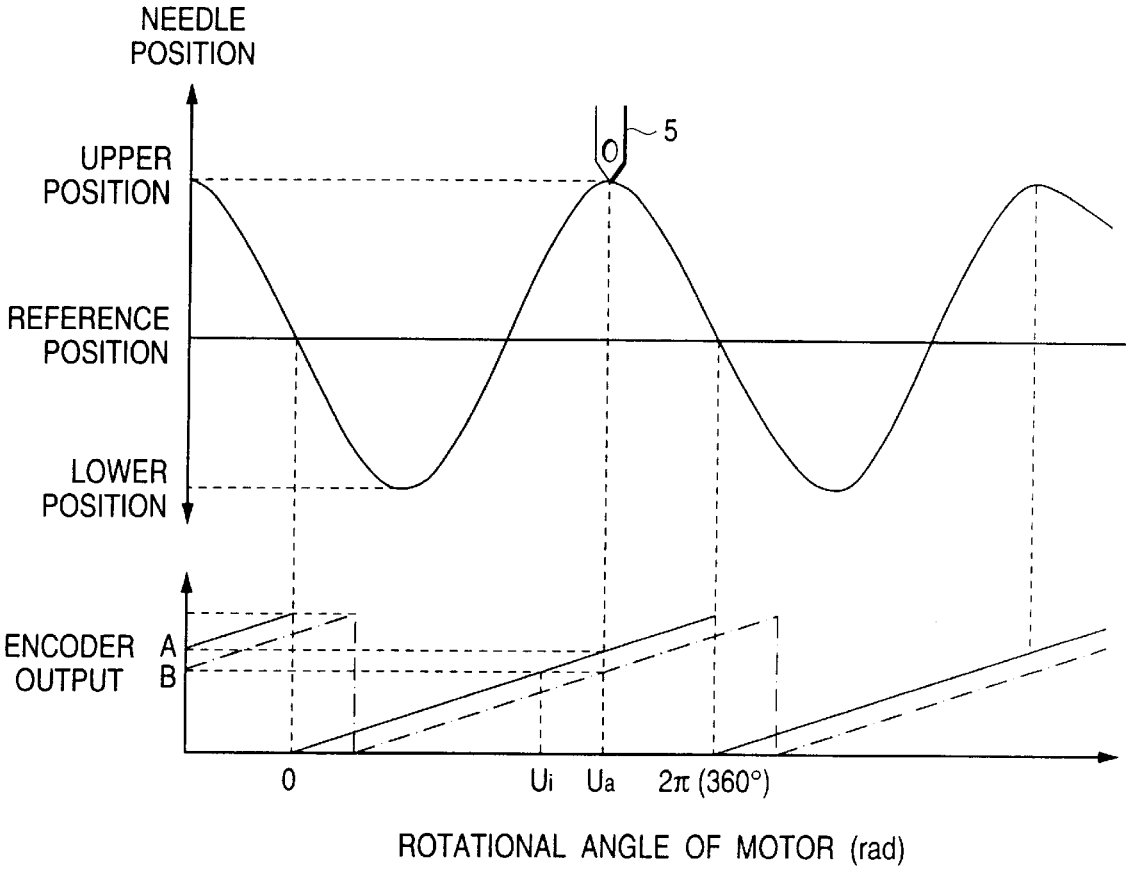
FIG. 7 PRIOR ART
FIG. 7 is a movement curve illustrating the vertical motion of a needle and a curve illustrating an output value of an encoder.

On the other hand, if the identification numbers do not agree with each other, the control CPU 53 prohibits the starting of the motor 7 (Step 309), and displays an error message on the display unit 36 of the operating section 30 (Step 311). Then, the control CPU 53 determines whether or not an angle setting switch 34 has been turned on (Step 313), and if it has been turned on, the operation automatically proceeds to the aforementioned upper-position-angle setting mode (Step 315). Namely, as showun in FIG. 7, after the operator moved the needle 5 to the position of the upper position, i.e., to A in the sawtooth output waveform of the encoder 9, if the operator turns on the angle setting switch 34, the display unit displays "UPSET," and the state is set in the set standby state. If the angle setting switch 34 is turned on, the value A of the upper-position angle is stored in the control memory 55, and at this upper-position angle, the sewing machine is readily operable.

Third Embodiment

Figure 4:
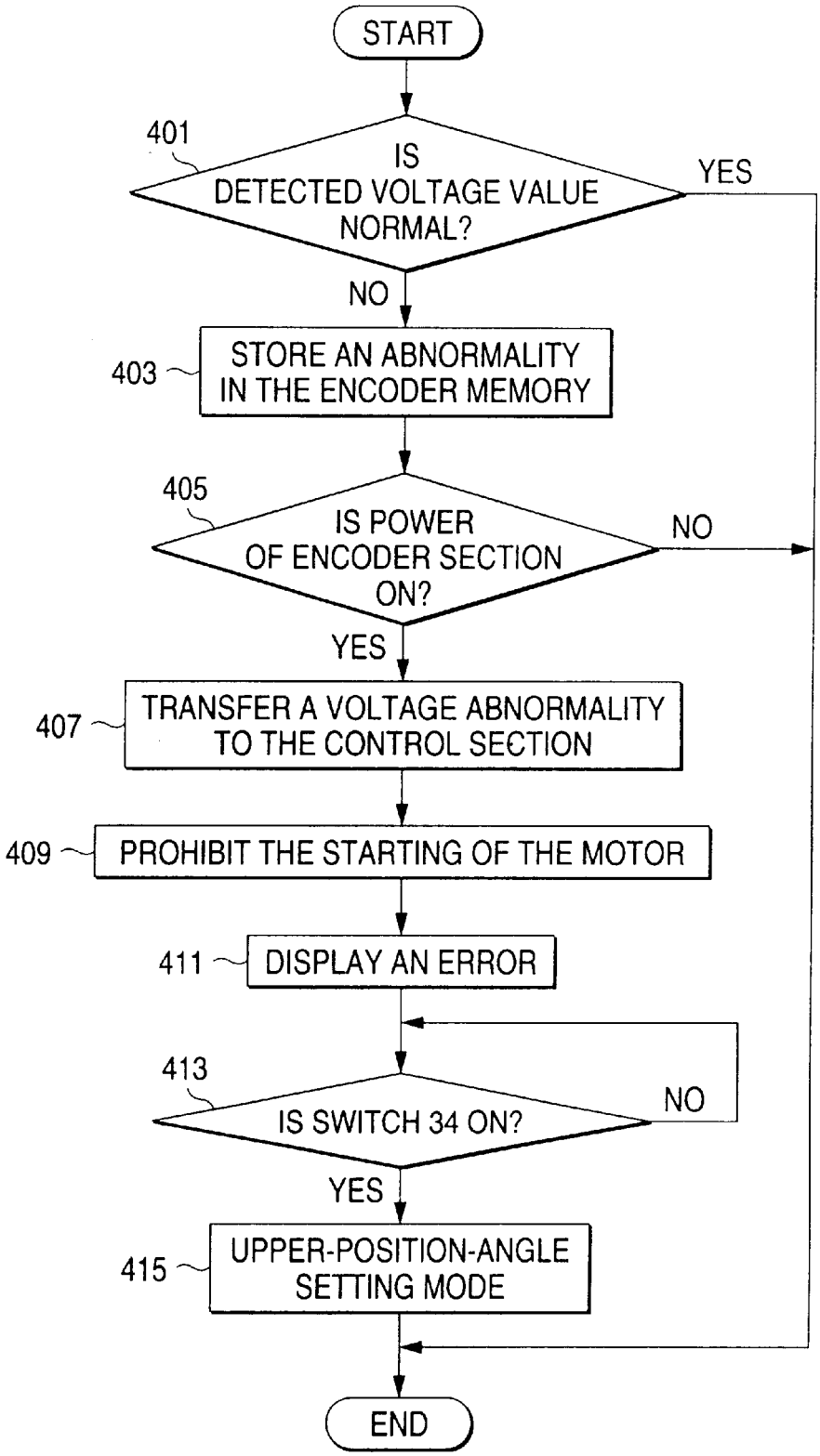
FIG. 4 is a flowchart illustrating still other operation of the controller for a sewing machine shown in FIG. 1.
Figure 5:
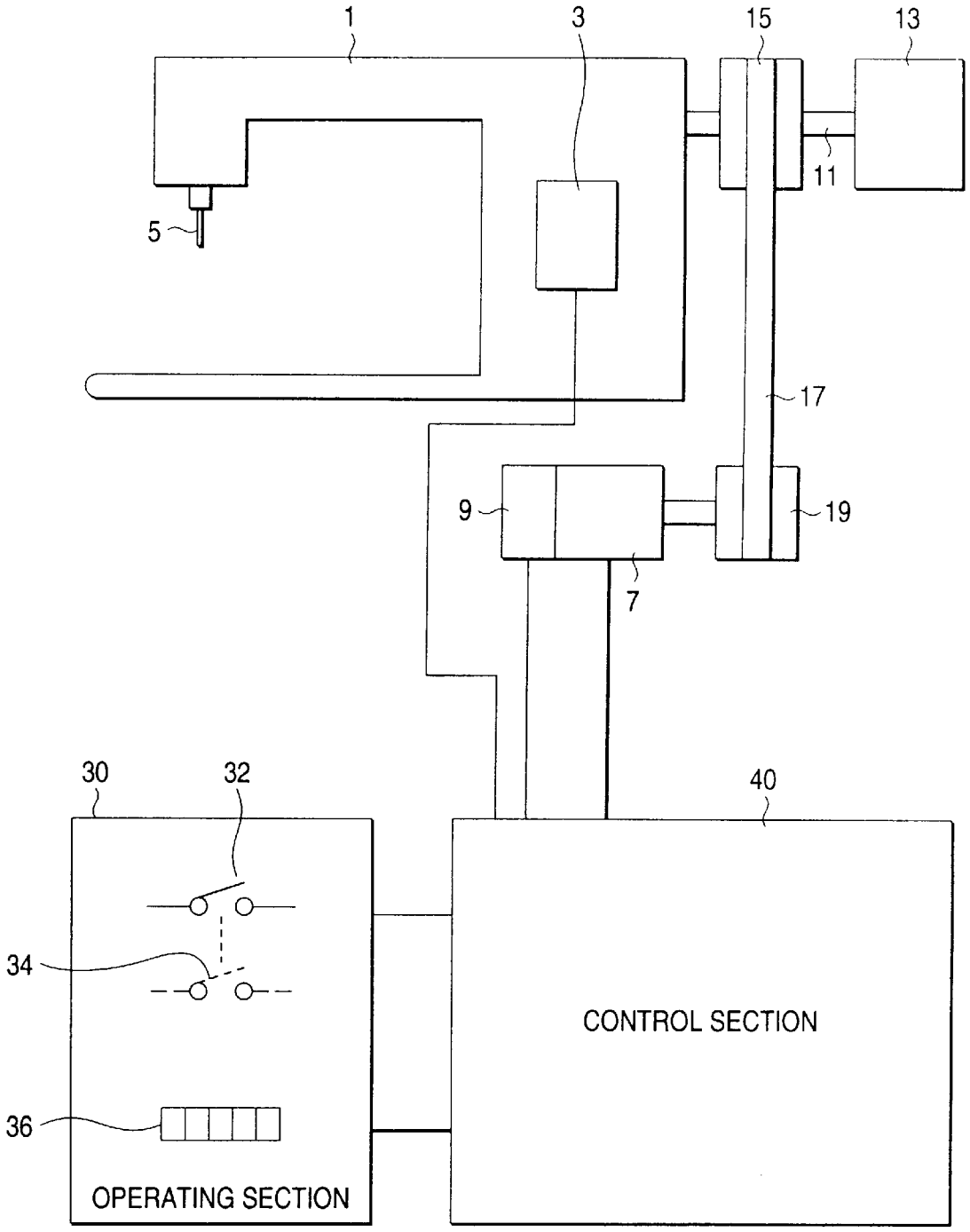
FIG. 5 PRIOR ART
FIG. 5 is an overall schematic diagram of the sewing machine.
Figure 6:
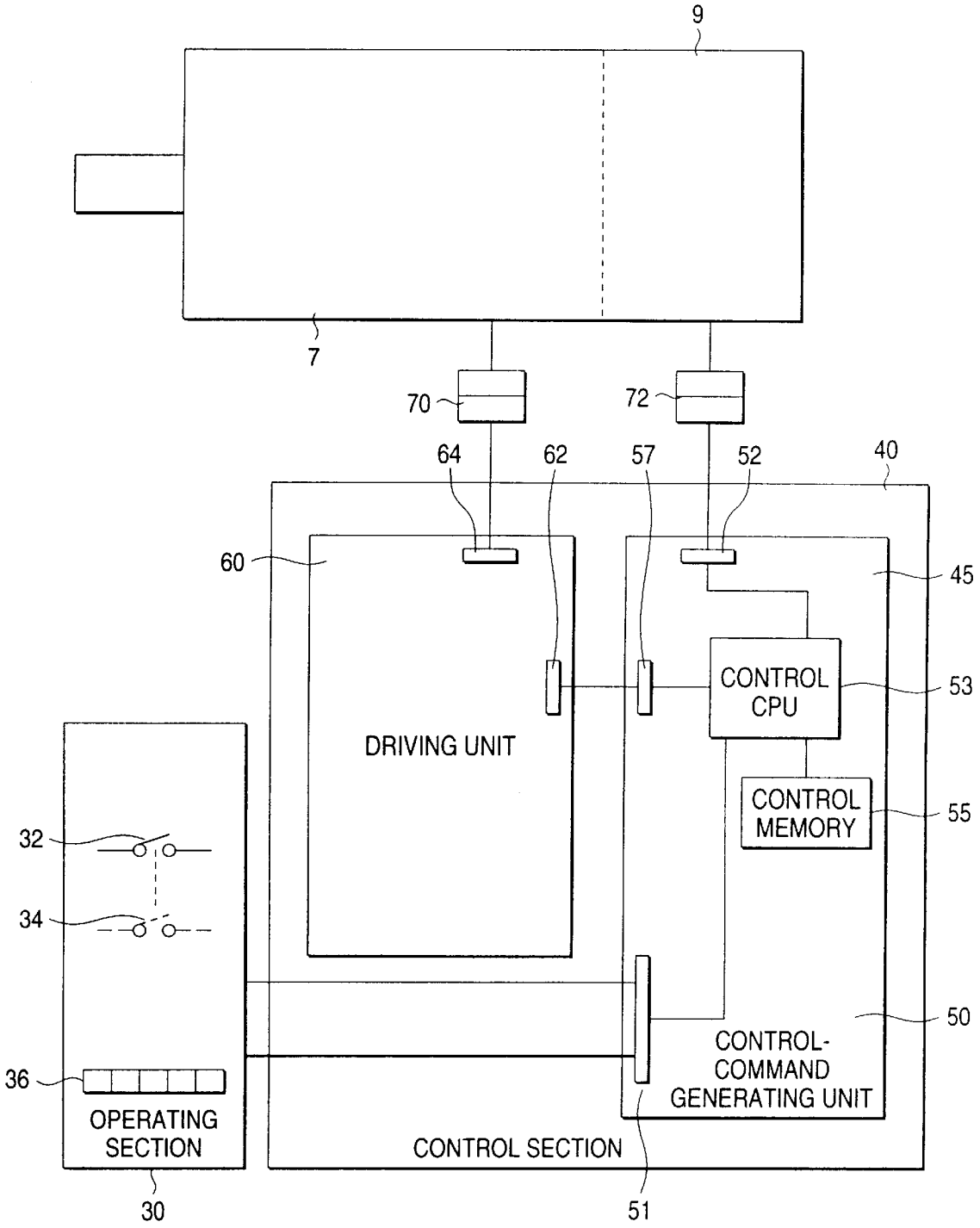
FIG. 6 PRIOR ART
FIG. 6 is a block diagram of a conventional controller for a sewing machine.

Referring to FIG. 4, a description will be given of still another embodiment of the present invention. In this embodiment, the replacement of the motor is detected by, for example, the attenuation of the voltage at the encoder controlling section 180 so as to set the needle at a predetermined angle.

The voltage detecting unit 181 determines whether or not the value of the supply voltage at the encoder controlling section 180 has attenuated (Step 401), and if the supply voltage value is normal, this processing ends. On the other hand, if the supply voltage value has attenuated, the encoder CPU 185 stores in the encoder memory 183 the fact that the value of the supply voltage at the encoder controlling section 180 is abnormal (Step 403). The voltage detecting unit 181 then determines whether or not the value of the supply voltage, after attenuating and becoming off, has returned to normal (on) (Step 405), and if the voltage value has not returned, this processing ends.

On the other hand, if the supply voltage value has returned, the encoder CPU 185 transfers to the control section 40 the fact that the supply voltage value has become abnormal (Step 407). The control CPU 53 then prohibits the starting of the motor 7 (Step 409), and displays an error message on the display unit 36 of the operating section 30 (Step 411). Then, the control CPU 53 determines whether or not the angle setting switch 34 has been turned on (Step 413), and if it has been turned on, the operation automatically proceeds to the aforementioned upper-position-angle setting mode (Step 415).

It should be noted that, in the above-described second and third embodiments, an arrangement may be provided such that the starting of the motor is prohibited, and the step of displaying an error is omitted, and the operation proceeds directly to the upper-position-angle setting mode.

As described above, according to a first aspect of the present invention, in the controller for a sewing machine in accordance with the first aspect of the invention, an advantage can be obtained in that since a predetermined positional angle of the needle is stored in the detecting unit or the designating unit, even if the control section has broken down and is replaced with another control section, the resetting of the predetermined positional angle of the needle becomes unnecessary.

According to a second aspect of the present invention, in the controller for a sewing machine, an advantage can be obtained in that since the starting of the motor is prohibited after detecting the replacement of the motor, the sewn object can be easily removed, and the needle is prevented from becoming broken.

According to a third aspect of the present invention, in the controller for a sewing machine, an advantage can be obtained in that since the predetermined position of the needle is detected after detecting the replacement of the motor, the sewn object can be easily removed, and the needle is prevented from becoming broken.

According to a fourth aspect of the present invention, in the controller for a sewing machine, in addition to the advantage of the second or third aspect of the invention, an advantage can be obtained in that since the motor-replacement detecting means makes the determination by the identification number of the motor, the replacement of the motor can be detected easily and reliably.

According to a fifth aspect of the present invention, in the controller for a sewing machine, in addition to the advantage of the second or third aspect of the invention, an advantage can be obtained in that since the motor-replacement detecting means makes the determination on the basis of the attenuation of the voltage at the detecting unit, the replacement of the motor can be detected easily and reliably.

INDUSTRIAL APPLICABILITY

As described above, the controller for a sewing machine in accordance with the present invention is suitable for designating the position of the needle.

What is claimed is:

1. A controller for a sewing machine, comprising:

a driving motor for driving a main shaft of a sewing machine head;

a detecting unit having a rotation-angle detecting means or detecting a rotational angle of said motor;

a control unit for controlling said motor and receiving detection signal of said detecting unit;

an operating section for instructing the operation of said sewing machine;

a designating means provided in said control unit or said operating section for designating a predetermined position in a vertically moving process of a needle of said sewing machine; and a first memory portion and a second memory portion for storing and reading a value designated by said designating means, wherein said first memory portion is provided in said control section, and said second memory portion is provided in said detecting unit or said operating section.

2. A controller for a sewing machine, comprising:

a driving motor for driving a main shaft of a sewing machine head;

a motor-replacement detecting means for detecting that said motor has been replaced with another motor; and a starting prohibiting means for prohibiting the starting of said motor if the replacement is detected by said motor-replacement detecting means.

3. A controller for a sewing machine, comprising:

a driving motor for driving a main shaft of a sewing machine head;

a motor-replacement detecting means for detecting that said motor has been replaced with another motor; and a designating means for designating a predetermined position of the needle if the replacement is detected by said motor-replacement detecting means.

4. The controller for a sewing machine according to claim 2 or 3, wherein said motor-replacement detecting means comprises:

a value designating means for designating an identification value of said motor;

an identification-value storing means for storing the identification value designated by said value designating means; and a determining means for determining whether or not the identification value of said motor and the identification value of another motor agree with each other.

5. The controller for a sewing machine according to claim 2 or 3, wherein said motor-replacement detecting means comprises:

a voltage detecting unit for effecting the detection by the attenuation of a voltage value of said detecting unit, an assumption being made on the basis of the attenuation of the voltage value of said voltage detecting unit that said motor has been replaced.

* * * * *